US007658665B2

(12) United States Patent
Subramanian et al.

(10) Patent No.: US 7,658,665 B2
(45) Date of Patent: Feb. 9, 2010

(54) TECHNIQUES FOR CYLINDRICAL GRINDING

(75) Inventors: Krishnamoorthy Subramanian, Lexington, MA (US); Lukasz A. Glinski, Worcester, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 0 days.

(21) Appl. No.: 11/973,524

(22) Filed: Oct. 9, 2007

(65) Prior Publication Data

US 2009/0093198 A1 Apr. 9, 2009

(51) Int. Cl.
*B24B 1/00* (2006.01)

(52) U.S. Cl. ..... 451/49; 451/53; 451/59

(58) Field of Classification Search ..... 29/895.3, 29/895.33, 898.068, 898.069, 899; 451/48, 451/49, 50, 53, 57, 58, 59
See application file for complete search history.

(56) References Cited

U.S. PATENT DOCUMENTS 4,905,418 A * 3/1990 Wedeniwski ..... 451/5
4,929,130 A 5/1990 Diebolt et al.
5,048,235 A * 9/1991 Smith ..... 451/72
5,104,424 A * 4/1992 Hickory et al. ..... 51/309
5,177,901 A * 1/1993 Smith ..... 451/72
5,203,122 A 4/1993 Campbell
5,205,081 A 4/1993 Kuehne et al.
5,330,326 A 7/1994 Kuehne et al.
5,398,455 A 3/1995 Slavin et al.
5,430,936 A 7/1995 Yazdzik, Jr. et al.
5,593,468 A * 1/1997 Khaund et al. ..... 51/309
5,738,696 A 4/1998 Wu
5,738,697 A 4/1998 Wu et al.
6,019,668 A * 2/2000 Ramanath et al. ..... 451/41
6,086,648 A * 7/2000 Rossetti et al. ..... 51/304
6,123,606 A 9/2000 Hill et al.
6,319,097 B1 * 11/2001 Coverdale et al. ..... 451/49
6,619,890 B2 9/2003 Hill (Continued)

FOREIGN PATENT DOCUMENTS

EP 0 395 087 A2 10/1990

(Continued)

OTHER PUBLICATIONS

Aspinwall, D. K., et al., "Hybrid High Speed Machining (HSM): System Design and Experimental Results for Grinding/HSM and EDM/HSM," Annals of CIRP, vol. 50/1, pp. 145-148, (2001).

(Continued)

*Primary Examiner*—Timothy V Eley
(74) *Attorney, Agent, or Firm*—Larson Newman & Abel, LLP; Mike W. Crosby

(57) ABSTRACT

Methods for cylindrical grinding a workpiece are disclosed. The method includes cylindrical grinding, with a bonded abrasive wheel having a permeable structure that includes interconnected porosity, a workpiece at a specific cutting energy of less than about 12 Hp/in$^3$·min (29.7 J/mm$^3$), and a material removal rate of at least about 1 in$^3$/min·in (10.8 mm$^3$/sec/mm)grinding. The bonded abrasive wheel may include at least about 3 volume percent of a filamentary sol-gel alpha-alumina abrasive grain having an average length-to-cross-sectional-width ratio of greater than about 4:1, or agglomerates thereof. In one embodiment, the workpiece is ground in the presence of a water soluble oil.

25 Claims, 2 Drawing Sheets

U.S. PATENT DOCUMENTS

| | | | | |
|---|---|---|---|---|
| 6,669,118 | B2 | 12/2003 | Webster | |
| 6,739,960 | B2 | 5/2004 | Sauer | |
| 6,767,168 | B2 | 7/2004 | Miller | |
| 6,883,234 | B2 | 4/2005 | Packman et al. | |
| 7,101,263 | B2 | 9/2006 | Schwartz et al. | |
| 2003/0194947 | A1 | 10/2003 | Bright et al. | |
| 2003/0194954 | A1* | 10/2003 | Bonner et al. | 451/49 |
| 2004/0064944 | A1 | 4/2004 | Packman et al. | |
| 2007/0275641 | A1* | 11/2007 | Subramanian et al. | 451/57 |
| 2008/0066387 | A1* | 3/2008 | Bonner et al. | 51/296 |

FOREIGN PATENT DOCUMENTS

| | | | |
|---|---|---|---|
| WO | 03/086703 | A1 | 10/2003 |

OTHER PUBLICATIONS

Burrows, J. M., et al., "Grinding of Inconel 718 and Udimet 720 Using Superabrasive Grinding Points Mounted on a High Speed Machining Centre," Proc. of 33rd MATADOE conf., pp. 447-452, ISBN 1852333235, (2000).

Burrows, J. M., et al., "Use of a High Speed Machining Centre for the CBN and Diamond Grinding of Nickel-Based Superalloys," Kluwer Academic/Plenum Publishers, ISBN 0306467259, pp. 267-275, (2002).

Dewes, R. C., et al., "High Speed Machining—Multi-Function/Hybrid Systems," Proceedings of the 4th International Conference on Industrial Tooling, Southhampton, UK, pp. 91-100, (2001).

Reis, D. D., et al., "The machining of aluminium alloy 6351," Proc. IMechE, vol. 219, Part B: J. Enginerring Manufacture, pp. 27-33, (2005).

Salmon, S., "Creep-Feed Grinding Is Surprisingly Versatile," Manufacturing Engineering, vol. 133, No. 5, (Nov. 2004).

Soo, S. L., et al., "Point grinding of nickel-based superalloys," Industrial Diamond Review, pp. 109-112, 115-116, (Feb. 2002).

"Why more shops have replaced milling & broaching with creep feed grinding," Grinding J., pp. 20-28, (Spring, 2007).

* cited by examiner

TECHNIQUES FOR CYLINDRICAL GRINDING

RELATED APPLICATIONS

This patent application is related to U.S. patent application Ser. No. 11/439,510, entitled "Method for Grinding Complex Shapes," the entire contents of which is incorporated herein by reference.

BACKGROUND OF THE INVENTION

Typically, cylindrical parts are produced by machining a workpiece and then, if necessary, grinding the workpiece.

Attempts have been made to develop high material removal rate (MRR) grinding processes. For example, high MRR outside diameter (OD) grinding processes have been developed as "high speed grinding" processes. Commonly, these high speed OD grinding processes use wheel speeds on the order of 120 meters/second (m/sec) to 300 m/sec, with the general approach of using the higher wheel speed to improve performance. These high speed OD grinding processes typically involve superabrasive (SA) grinding wheels composed of diamond or boron nitride and often having a metal bond, e.g., an electroplated metal bond.

These conventional grinding processes have employed a 100% oil coolant at high pressure to reduce friction, to induce lubricity in the metal-to-metal contact surfaces, and to prevent thermal damage and residual stress to the workpiece. To prevent occasional sparks that could present a fire hazard, these grinding processes typically use a substantial excess of the oil coolant to immerse the grinding zone with the coolant. Large quantities of chips are produced, are directed into the oil coolant, and are difficult to remove, necessitating complex and expensive waste disposal.

In spite of these limitations, high speed OD grinding is practiced on occasion to replacing traditional machining (e.g., turning, milling, or turn broaching). However, application of high speed OD grinding has been limited to small volume part production. In high volume production, the disadvantages of high speed OD grinding are compounded by another serious constraint of the process—the gradual and constant wear of the superabrasive grains, e.g., cubic boron nitride grains. The gradual and constant wear can lead to constant changes in part quality, especially in the case of long cylindrical parts such as, for example, crank shafts. Furthermore, large volume production is not suited to on-line dressing of superabrasive grinding wheels made of galvanic processes. Such wheels are generally used for high speed cylindrical grinding applications with high MRR. This poses another constraint to the implementation of large volume production using high speed OD grinding.

Therefore, there is a need to develop new grinding methods overcoming or minimizing one or more of the shortcomings associated with conventional processes, such as high speed OD grinding.

SUMMARY OF THE INVENTION

One embodiment of the present invention is directed to a method for cylindrical grinding of a workpiece with a rotating bonded abrasive wheel. The method includes cylindrical grinding (with a bonded abrasive wheel having a permeable structure that includes interconnected porosity) the workpiece at a specific cutting energy of less than about 12 $Hp/in^3 \cdot min$ (29.7 $J/mm^3$), and a material removal rate of at least about 1 $in^3/min \cdot in$ (10.8 $mm^3/sec/mm$). In some such cases, the specific cutting energy is no greater than about 10 $Hp/in^3 \cdot min$ (27 $J/mm^3$) or even lower, and the material removal rate is at least about 5 $in^3/min \cdot in$ (54 $mm^3/sec/mm$) or even higher. As will be appreciated in light of this disclosure, such low specific cutting energies can minimize heat generation in the grinding zone and thus reduce the risk of metallurgical damage to the workpiece. The bonded abrasive wheel can be configured in a number of ways, and in one particular case, includes at least about 3 volume percent of a filamentary sol-gel alpha-alumina abrasive grain having an average length-to-cross-sectional-width ratio of greater than about 4:1, or agglomerates thereof. Other abrasive types and/or agglomerates will be apparent in light of this disclosure (e.g., superabrasive grains such as diamonds or cubic boron nitride held together by a bond in agglomerate form). The bonded abrasive wheel may include, for example, about 35 to about 80 volume percent interconnected porosity.

In some instances, the workpiece is ground in the presence of a water soluble oil. For example, the workpiece can be ground in the presence of a coolant which includes water soluble oil and water (e.g., about 3 to about 6 percent by volume water soluble oil). The water soluble oil and water coolant can be environmentally superior to traditional oil coolant. In addition, coolants which include water soluble oil and water can be less costly to dispose of than traditional oil coolants and can also provide better working conditions for operators of grinding equipment. Coolants that include water soluble oil and water may more effectively remove heat from the workpiece or the abrasive wheel relative to traditional oil coolants. Better heat removal can reduce the risk of metallurgical damage to the workpiece and can permit operation at higher machine speeds than would be otherwise possible or advisable. Note, however, that a coolant which includes water soluble oil and water may provide less lubrication than a traditional oil coolant. Thus, it is unexpected that a coolant which includes water soluble oil and water can be effectively used in a cylindrical grinding method, as described herein.

In other embodiments, methods disclosed herein can be used in conjunction with traditional machining processes. For example, a workpiece can be ground using one or more methods disclosed herein, and then the workpiece can be further processed using conventional milling or grinding. Such further grinding or machining can be used, for example, to deliver particular surface features, to refine tolerances, or to create a particular geometry. Alternatively, the workpiece can be ground or machined using conventional techniques, and then the workpiece can be ground using methods disclosed herein.

The method can be economically used for both low and high volume production processes and, for example, for high material removal rate (MRR) applications, in place of traditional machining processes such as turning, milling, and turn broaching. A good surface finish is provided on the workpiece in a relatively short process time as compared to conventional machining processes. In addition, process costs can be lowered relative to conventional processes (e.g., machining and milling) without compromising surface-finish quality or structural integrity of the resultant work product. Furthermore, coolant disposal costs can be significantly decreased when coolant which includes water soluble oil and water is used in place of traditional oil coolant. In addition, high MRRs can be achieved without time consuming and complex tool set-ups typically needed to achieve similar MRRs in conventional machining operations. Such benefits can be achieved on a variety of difficult to finish workpiece materials, such as hardened or soft nickel alloys, titanium alloys, iron, steel (e.g., AISI 4340, AISI D2, AISI 1018, and AISI 4340), and other metal alloys in various hardness grades.

BRIEF DESCRIPTION OF THE DRAWINGS

The foregoing will be apparent from the following more particular description of example embodiments of the present invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

Unlike conventional machining processes, cylindrical grinding techniques disclosed herein can be economically used for both low and high volume production processes. Cost efficiencies can be obtained, for example, through reduction or elimination of conventional machining processes and process simplification, through lower machine costs possible with lower speed operation, or through dressing abrasive wheels online and the ability to generate complex profiles on hard and difficult to machine work materials. Cylindrical grinding includes, for example, outside diameter (OD) cylindrical grinding, inside diameter (ID) cylindrical grinding, and centerless grinding.

Figure 1A:
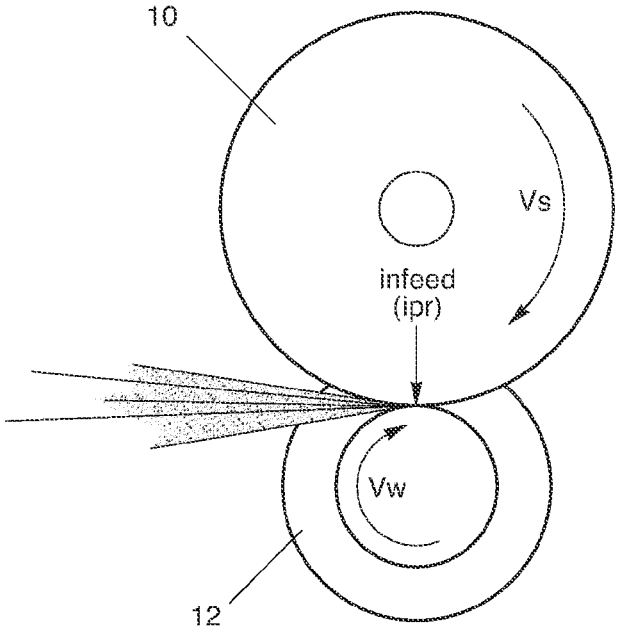
FIGS. 1A and 1B are schematic representations of an OD cylindrical grinding process according to one embodiment of the present invention.
Figure 1B:
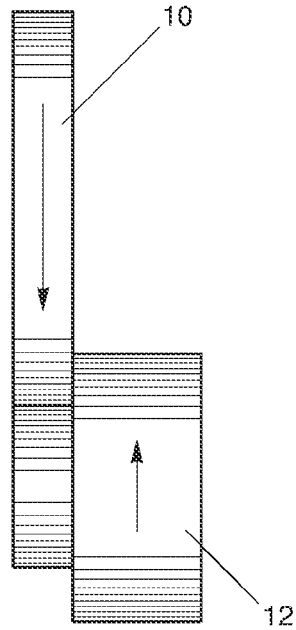

FIGS. 1A and 1B are two schematic views of an OD cylindrical grinding method according to one embodiment of the present invention. Bonded abrasive wheel 10 rotating at velocity $v_S$ acts on workpiece 12 rotating at velocity $v_W$. As can be seen, the infeed in this example is expressed in inches per revolution (ipr). Theoretical MRR can be computed by multiplying the velocity of workpiece 12 by the infeed. In the embodiment shown, abrasive wheel 10 and workpiece 12 are rotating in opposite directions. In other embodiments, abrasive wheel 10 and workpiece 12 may rotate in the same direction. The method illustrated in FIGS. 1A and 1B can also include the application of a coolant, not shown. In one embodiment, a coolant comprised of water soluble oil and water is applied.

Any type of material, including hard-to-grind material, can be ground as described herein. The disclosed cylindrical grinding techniques can be used to grind workpieces over a wide range of hardness values, for example, 84 Rb to 65 Rc. This is in contrast to known machining processes that typically can be used only for softer materials, such as those having a maximum hardness value of about 32 Rc. Example metallic workpieces have a hardness value of about 32 Rc to about 65 Rc. Specific examples of workpiece materials include titanium, Inconel (e.g., IN-718), iron (e.g., ductile iron, 80-60-03), carbon steel (e.g., AISI D2, AISI 4340, AISI 1018), alloys, and combinations thereof.

In one embodiment, the bonded abrasive wheel used includes a bond and at least about 3 volume percent of a filamentary sol gel alpha-alumina abrasive grain, and, optionally, further including secondary abrasive grains or agglomerates thereof. The secondary grain may have a similar composition to the primary sol gel alpha-alumina grain, but at a different size. Alternatively, the secondary grain can be a different abrasive material suitable for the given application, such as diamond, cubic boron nitride, or silicon carbide. Various example bonded abrasive tools suitable for use in accordance with an embodiment of the present invention are disclosed in U.S. Pat. Nos. 5,129,919, 5,738,696, 5,738,697, 6,074,278, 6,679,758, 6,988,937 as well as U.S. patent application Ser. No. 11/240,809, each of which is incorporated herein by reference in its entirety. In one specific grinding process embodiment, a vitrified abrasive wheel is employed, although other wheel types (e.g., resinous and metal bonds) can be used as well, as will be apparent in light of this disclosure. In some instances, the filamentary sol gel alpha-alumina abrasive grains comprise predominantly alpha alumina crystals having a size no greater than 1 micron. As will be apparent in light of this disclosure, agglomerates of bond (e.g., organic or inorganic) and abrasive grain can be bonded together to provide grinding wheels having suitable levels of porosity and other desirable features.

Bonded abrasive tools that can be used for grinding processes configured in accordance with an embodiment of the present invention have a combination of high mechanical strength and wear resistance along with an open, permeable structure having interconnected porosity. In one such embodiment, the bonded abrasive wheel has at least about 35% porosity such as about 35% to about 80% porosity by volume of the wheel. In one such case, at least about 30% by volume of the total porosity is interconnected porosity. Interconnected porosity can be achieved in a number of ways, as will be appreciated in light of this disclosure. For instance, interconnected porosity can be provided by using low packing density filamentary grains (e.g., U.S. Pat. Nos. 5,129,919, 5,738,696, and 5,738,697), or by using abrasive agglomerates (e.g., U.S. Pat. Nos. 6,679,758 and 6,988,937), or by leaching of a dispersoid from the bond matrix (e.g., U.S. Pat. Nos. 6,685,755 and 6,755,729, each of which are incorporated herein by reference in its entirety). Interconnected porosity can be tested, for example, by measuring the permeability of the abrasive tool to the flow of air or water under controlled conditions, as disclosed in previously incorporated U.S. Pat. Nos. 5,738,696 and 5,738,697.

Specific examples of suitable bonded abrasive wheels that can be used for the methods of the invention include ALTOS™ monolithic and OPTIMOS™ segmented abrasive rim grinding wheels, currently available from Saint-Gobain Abrasives in Worcester, Mass. ALTOS™ and OPTIMOS™ abrasive tools employ sintered sol gel alpha-alumina ceramic grains with an average aspect ratio of about 8:1, such as NORTON® TG2 or TGX Abrasives (NORTON® is a trademark of Saint-Gobain Abrasives, Inc.), as a filamentary abrasive grain. U.S. Pat. Nos. 5,738,696 and 5,738,697 describe additional details for ALTOS™ monolithic grinding wheels, and U.S. Pat. No. 6,074,278 describes additional details for OPTIMOS™ segmented abrasive rim grinding wheels.

Abrasive Grains

In one specific example, the bonded abrasive wheel used for grinding in accordance with an embodiment of the present invention includes a vitrified bond and about 3 to about 43 volume percent of a filamentary sol-gel alpha-alumina abrasive grain having an average length-to-cross-sectional-width aspect ratio of greater than about 4:1, or even greater than about 5:1, or still even greater than about 7.5:1, or agglomerates thereof. Such filamentary grain and tools are described in further detail, for example, in U.S. Pat. No. 5,009,676, which is incorporated herein by reference in its entirety, as well as in the previously incorporated U.S. Pat. No. 5,129,919. In one such case, the filamentary sol gel alpha-alumina abrasive grain has an average length-to-cross-sectional-width aspect ratio of at least 5:1 and comprises predominantly alpha alumina crystals having a size no greater than 1 micron. Numerous filamentary abrasive grains (e.g., having an average aspect ratio ranging from about 4:1 to about 25:1) can be used, as will be apparent in light of this disclosure. As used herein, the "average aspect ratio" or the "length-to-cross-sectional-width-aspect ratio" refers to the ratio between the length along the principal or longer dimension and the greatest extent of the grain along any dimension perpendicular to the principal dimension. In cases where the cross-section is other than round (e.g., polygonal), the longest measurement perpendicular to the lengthwise direction is used in determining the aspect ratio.

In addition to filamentary grain, one or more of secondary abrasive grains can be included in the bonded abrasive wheels that are employed in grinding processes configured in accordance with an embodiment of the present invention. Secondary grains may be present, for example, in amounts from 12 to 40 volume percent of the tool. Combined filamentary and secondary grains may be present in amounts of 15 to 45 volume percent of the tool. Examples of such secondary abrasive grains include alumina grains, such as: fused alumina, sol-gel sintered alumina, sintered bauxite, and the like; silicon carbide; alumina-zirconia, including cofused alumina-zirconina and sintered alumina-zirconina; aluminum oxynitride; ceria; boron suboxide; garnet; flint; diamond, including natural and synthetic diamond; cubic boron nitride (CBN); and combinations thereof. The secondary abrasive grain can be any shape, including filamentary shapes.

Additional examples of suitable abrasive grains include unseeded, sintered sol-gel alumina abrasive grains that include microcrystalline alpha-alumina and at least one oxide modifier, such as rare-earth metal oxides (e.g., $CeO_2$, $Dy_2O_3$, $Er_2O_3$, $Eu_2O_3$, $La_2O_3$, $Nd_2O_3$, $Pr_2O_3$, $Sm_2O_3$, $Yb_2O_3$ and $Gd_2O_3$), alkali metal oxides (e.g., $Li_2O$, $Na_2O$ and $K_2O$), alkaline-earth metal oxides (e.g., MgO, CaO, SrO and BaO) and transition metal oxides (e.g., $HfO_2$, $Fe_2O_3$, MnO, NiO, $TiO_2$, $Y_2O_3$, ZnO and $ZrO_2$) (see, for example, U.S. Pat. Nos. 5,779,743, 4,314,827, 4,770,671, 4,881,951, 5,429,647 and 5,551,963, each of which are incorporated herein by reference in its entirety). Specific examples of unseeded, sintered sol-gel alumina abrasive grains include rare-earth aluminates represented by the formula of $LnMAl_{11}O_{19}$, wherein Ln is a trivalent metal ion such as La, Nd, Ce, Pr, Sm, Gd, or Eu, and M is a divalent metal cation such as Mg, Mn, Ni, Zn, Fe, or Co (see, for example, U.S. Pat. No. 5,779,743). Such rare-earth aluminates generally have a hexagonal crystal structure, sometimes referred to as a magnetoplumbite crystal structure.

The term "filamentary" abrasive grain refer to filamentary ceramic abrasive grain having a generally consistent cross-section along its length, where the length is greater than the maximum dimension of the cross-section. In some embodiments, the maximum cross-sectional dimension can be as high as about 2 mm, although other embodiments can have a maximum cross-sectional dimension below about 1 mm or even below about 0.5 mm. The filamentary abrasive grain may be straight, bent, curved or twisted so that the length is measured along the body rather than necessarily in a straight line. In one embodiment, the filamentary abrasive grain is curved or twisted. Still in other embodiments, multiple filaments (two or more) can be twisted or otherwise bonded together to form an agglomerate of such filamentary abrasive grain. In some instances, filamentary sol-gel alumina abrasive grain includes polycrystals of sintered sol-gel alpha-alumina. Seeded or unseeded sol-gel alpha-alumina can be included in the filamentary sol-gel alpha-alumina abrasive grain. In one embodiment, a filamentary, seeded sol-gel alpha-alumina abrasive grain is used for the blend of abrasive grains. In some embodiments, the sintered sol-gel alpha-alumina abrasive grain includes predominantly alpha alumina crystals having a size of less than about 2 microns, or alternatively between 1 to 2 microns, or alternatively less than 1 micron, or alternatively less than 0.4 microns.

Sol-gel alpha-alumina abrasive grains can be made, for example, in accordance with U.S. Pat. Nos. 4,623,364; 4,314,827; 4,744,802; 4,898,597; 4,543,107; 4,770,671; 4,881,951; 5,011,508; 5,213,591; 5,383,945; 5,395,407; and 6,083,622, each of which is incorporated herein by reference in its entirety. For example, typically they are generally made by forming a hydrated alumina gel which may also contain varying amounts of one or more oxide modifiers (e.g., MgO, $ZrO_2$ or rare-earth metal oxides), or seed/nucleating materials (e.g., $\alpha$-$Al_2O_3$, $\gamma$-$Al_2O_3$, $\alpha$-$Fe_2O_3$ or chromium oxides), and then drying and sintering the gel (see, for example, U.S. Pat. No. 4,623,364). Typically, the filamentary sol-gel alpha-alumina abrasive grains can be obtained by a variety of methods, such as by extruding or spinning a sol or gel of hydrated alumina into continuous filamentary grains, drying the filamentary grains so obtained, cutting or breaking the filamentary grains to the desired lengths and then firing the filamentary grains to a temperature of, for example, not more then about 1500° C. Example such filamentary grain manufacturing methods are described in U.S. Pat. Nos. 5,244,477, 5,194,072 and 5,372,620, each of which is herein incorporated by reference in its entirety.

As previously explained, the bonded abrasive wheel may include agglomerated abrasive grains. As is known, agglomerated abrasive grain refers to three-dimensional granules comprising abrasive grain and a binding material. In some instances, the agglomerates have at least 35 volume percent porosity, although dense agglomerates can be used as well. The agglomerates can be made, for example, from filamentary grains as previously described, or from blocky or sphere-shaped abrasive grain (e.g., alumina, diamond, or cubic boron nitride grains) having an aspect ratio of about 1.0. Example agglomerated abrasive grains are described in U.S. Pat. No. 6,679,758. Examples of blends of a filamentary sol-gel alpha-alumina abrasive grain and agglomerated abrasive grains are disclosed in previously incorporated U.S. patent application Ser. No. 11/240,809. Grain blends comprising filamentary abrasive grains, either in loose form and/or in agglomerated form, together with agglomerated abrasive grain comprising blocky or sphere-shaped abrasive grains having an aspect ratio of about 1.0 can also be used for the bonded abrasive wheel. One or more secondary abrasive grains in loose form can be optionally included together with a filamentary sol-gel alpha-alumina abrasive grain, or a blend of a filamentary sol-gel alpha-alumina abrasive grain and agglomerated abrasive grains, as will be apparent in light of this disclosure.

In one embodiment, a blend of a filamentary sol-gel alpha-alumina abrasive grain and agglomerated abrasive granules of abrasive grains, as described above, includes about 5% to about 90%, preferably about 25% to about 90%, more preferably about 45% to about 80%, by weight of the filamentary sol-gel alpha-alumina abrasive grain with respect to the total weight of the blend. The blend further includes about 5% to about 90%, preferably about 25% to about 90%, more preferably about 45% to about 80%, by weight, of the agglomerated abrasive grain. The blend optionally contains a maximum of about 50%, preferably about 25%, by weight of secondary abrasive grain that is neither the filamentary grain, nor the agglomerated grain. In such a case, the selected quantities of the filamentary grain, the agglomerated grain, and the optional secondary abrasive grain total 100%, by weight, of the total grain blend making up the abrasive wheel.

In another particular example embodiment that includes agglomerates of filamentary abrasive grain, the amounts of the filamentary abrasive grain in the agglomerate is in a range of about 15% to about 95%, preferably about 35% to about 80%, more preferably about 45 to about 75%, by weight with respect to the total weight of the agglomerate. The amount of the secondary abrasive grains in the agglomerate is in a range of about 5% to about 85%, preferably about 5% to about 65%, more preferably about 10% to about 55%, by weight with respect to the total weight of the agglomerate. As in the case of blends of filamentary abrasive grain and agglomerated abrasive grain, optional secondary abrasive grain may be added to the agglomerated filamentary grain to form the total grain blend used in the abrasive tool. As previously discussed, a maximum of about 50%, preferably about 25%, by weight, of the optional secondary abrasive grain may be blended with the filamentary grain agglomerate to arrive at the total grain blend used in the abrasive wheel.

Bond Materials

Any number of bond materials can be used, in accordance with various embodiments of the present invention. In one embodiment, the bond component of the abrasive wheel comprises inorganic materials selected from the group consisting of ceramic materials, vitrified materials, vitrified bond compositions and combinations thereof. Vitrified bond materials may be a pre-fired glass ground into a powder (a frit), or a mixture of various raw materials such as clay, feldspar, lime, borax and soda, or a combination of fritted and raw materials. Such materials fuse and form a liquid glass phase at temperatures ranging from about 500° C. to about 1400° C. and wet the surface of the abrasive grain to create bond posts upon cooling, thus holding the abrasive grain within a composite structure. Examples of suitable bonds may be found, for example, in U.S. Pat. Nos. 4,543,107; 4,898,597; 5,203,886; 5,025,723; 5,401,284; 5,536,283, 5,095,665; 5,711,774; 5,863,308; and 5,094,672, each of which is incorporated herein by reference in its entirety. For example, suitable vitreous bonds include conventional vitreous bonds used for fused alumina or sol-gel alpha-alumina abrasive grains. Such bonds are described in U.S. Pat. Nos. 5,203,886, 5,401,284 and 5,536,283. These vitreous bonds can be fired at relatively low temperatures (e.g., about 850° C. to about 1200° C.). Other vitreous bonds suitable for the abrasive wheel may be fired at temperatures below about 875° C. Examples of these bonds are disclosed in U.S. Pat. No. 5,863,308. In one specific example, the vitreous bond of the abrasive wheel is an alkali boro alumina silicate (see, for example, U.S. Pat. Nos. 5,203,886, 5,025,723 and 5,711,774). In one specific case, the vitreous bonds are contained in the compositions of the abrasive wheel in an amount of less than about 28% by volume, such as between about 3 and about 25 volume percent; between about 4 and about 20 volume percent; and between about 5 and about 18.5 volume percent.

Suitable binding materials for use in the agglomerates can be found, for example, in previously incorporated U.S. Pat. Nos. 6,679,758 and 6,988,937. Example binding materials may also be characterized by a viscosity of about 345 to 55,300 poise at about 1180° C., and a melting temperature of about 800° C. to about 1300° C.

The amounts of bond and abrasive (whether agglomerated or not) may vary, for example, from about 3% to about 25% bond and about 10% to about 70% abrasive grain, by volume, of the tool. In one particular embodiment, the abrasive grains are present in the bonded abrasive tool in an amount of about 10% to about 60%, more preferably about 20% to about 52%, by volume of the tool. The amount of bond holding the abrasive grains (or agglomerates) together in the tool shape can vary depending upon the type of bond used, as will be apparent in light of this disclosure. Note that the binder that makes up the agglomerate (first phase binder) can be different than the binder holding the agglomerates together to form the tool (second phase binder).

In another embodiment, the abrasive wheels can be bonded with a resinous bond. Suitable resin bonds include, for example, phenolic resins, urea-formaldehyde resins, melamine-formaldehyde resins, urethane resins, acrylate resins, polyester resins, aminoplast resins, epoxy resins, and combinations thereof. Specific examples of suitable resin bonds and techniques for manufacturing such bonds can be found, for example, in U.S. Pat. Nos. 6,251,149; 6,015,338; 5,976,204; 5,827,337; and 3,323,885, each of which is incorporated herein by reference in its entirety. Typically, the resin bonds are contained in the compositions of the abrasive tools in an amount of about 3% to about 48% by volume. Optionally, additives, such as fibers, grinding aids, lubricants, wetting agents, surfactants, pigments, dyes, antistatic agents (e.g., carbon black, vanadium oxide, graphite, etc), coupling agents (e.g., silanes, titanates, zircoaluminates, etc), plasticizers, suspending agents and the like, can be further added into the resin bonds. A typical amount of the additives is up to about 70% by volume of the tool.

The bonded abrasive wheel used in accordance with one particular embodiment of the present invention contains from about 0.1% to about 80% porosity by volume of the tool. More preferably, bonded abrasive wheel contains from about 35% to about 80% porosity by volume of the tool, and even more preferably it contains from about 40% to about 68% porosity by volume of the tool. The bonded abrasive wheel can be made by any suitable methods known in the art. For example, a blend of abrasive grains can be combined with a bond component. The combined blend of abrasive grains and bond component can be molded into a shaped composite, for example, including at least about 35 volume percent porosity. The shaped composite of the blend of abrasive grains and bond component can then be heated to form the bonded abrasive wheel.

Coolant—Water Soluble Oil

As previously explained, the rotating workpiece can be ground in the presence of a water soluble oil. For instance, the rotating workpiece can be ground in the presence of a coolant which includes water soluble oil and water. Coolant can be provided, for example, to the grinding zone between the abrasive wheel and workpiece. Applying a coolant can minimize thermal damage in the workpiece being ground. The applied coolant can be applied, for example, in the form of a coherent jet, as described in U.S. Pat. No. 6,669,118, which is incorporated herein by reference in its entirety. In one such configuration, coherent jets of coolant are provided through one or more modular nozzles that are configured (e.g., sized and shaped) to provide such coherent jets. The coherent jets of coolant are applied to the grinding zone in a nominally tangential direction at a predetermined temperature, pressure and flow rate. Generally, the temperature, pressure and flow rate are each independently chosen depending upon operation parameters for the specific grinding processes such as grinding speeds, material removal rates and specific cutting energy. A desired flow rate of coolant for a grinding operation and a desired coolant pressure required to generate a coolant jet speed that matches the grinding wheel speed can be determined by methods known in the art, such as that described in U.S. Pat. No. 6,669,118. Also, a nozzle discharge area capable of achieving the flow rate at the pressure, and a suitable nozzle configuration can be determined by methods known in the art, such as that described in U.S. Pat. No. 6,669,118.

In one embodiment, the flow rate of coolant applied is determined either using the width of the grinding zone or by using the power being consumed by the grinding process. For example, 25 gallons per minute (GPM) per inch (4 liters per minute per mm) of grinding wheel contact width is generally effective in many grinding applications. Alternatively, a power-based model of 1.5 to 2 GPM per spindle horsepower (8-10 liters per min per kilowatt (KW)) can be more appropriate in many applications, since it corresponds to the severity of the grinding operation. Also, the coolant jet may optimally be adjusted to reach the grinding zone at a velocity that approximates that of the grinding surface of the grinding wheel. This grinding wheel speed may be determined empirically, e.g., by direct measurement, or by simple calculation using the rotational speed of the wheel and the wheel diameter. The pressure required to create a jet of known velocity may be determined using an approximation of Bernoulli's equation. A range of modular nozzle configuration (e.g., such as rectangular nozzles and round nozzles) can be used to apply coherent jets of coolant.

Example coolants include water-based coolants and water soluble oil-based coolants. Specific examples of the water soluble oils include Rotorol Syn (Oel-Held GmbH; Stuttgart, Germany). Also useful in grinding processes configured in accordance with an embodiment of the present invention are various commercial water-based metal working fluids for machining and grinding applications that are available from Castrol (BP Lubricants, USA, Inc.; Wayne, N.J.), Master Chemical Co. (Perrysburg, Ohio), and other suppliers. In one embodiment, the water-soluble oil is biodegradable. In some instances, the water-soluble oil is dermatologically harmless. In some embodiments, the water-soluble oil has good anti-corrosive properties. One example of a water soluble oil meeting each of these criteria is Rotorol Syn. Rotorol Syn is amine, chlorine, boracic acid, and nitrate-free and does not contain mineral oil. The density of Rotorol Syn at 20° C. (1.18 g/cm$^3$) is to DIN 51 757. The pH of a 3% solution of Rotorol Syn (pH 9.1) is to DIN 51 369. The protection to corrosion at 5% of Rotorol Syn (0-0) is to DIN 51 360 T2.

In some embodiments, the coolant contains a concentration of about 1% to about 20% (by volume) water soluble oil, with more specific examples being about 2% to about 8% or about 3% to about 6% (by volume). The bonded abrasive wheel can be rotated, for example, at a velocity between about 66 m/sec to about 150 m/sec. The specific cutting energy (SCE) of a method for cylindrical grinding in accordance with an embodiment of the present invention is, for example, less than about 12 Hp/in$^3$·min (29.7 J/mm$^3$). In one specific embodiment, the SCE is no greater than about 10 Hp/in$^3$·min (27 J/mm$^3$), such as no greater than about 9 Hp/in$^3$·min (24.3 J/mm$^3$), no greater than about 8 Hp/in$^3$·min (21.6 J/mm$^3$), or no greater than about 5 Hp/in$^3$·min (13.5 J/mm$^3$). The SCE can range, for example, from about 1.0 Hp/in$^3$·min (2.7 J/mm$^3$) to about 10 Hp/in$^3$·min (27 J/mm$^3$). Specific embodiments within this example range include an SCE from about 1 Hp/in$^3$·min (2.7 J/mm$^3$) to about 9 Hp/in$^3$·min (24.3 J/mm$^3$), or from about 1 Hp/in$^3$·min (2.7 J/mm$^3$) to about 8 Hp/in$^3$·min (21.6 J/mm$^3$), or from about 1 Hp/in$^3$·min (2.7 J/mm$^3$) to about 5 Hp/in$^3$·min (13.5 J/mm$^3$). In one particular such embodiment, the SCE is in a range from about 1.4 Hp/in$^3$·min (3.8 J/mm$^3$) to about 4 Hp/in$^3$·min (10.8 J/mm$^3$).

The grinding methods of the invention are conducted, for example, at a material removal rate (MRR) of at least about 1 in$^3$/min·in (10.8 mm$^3$/sec/mm). Other embodiments have an MRR of at least about 5 in$^3$/min·in (54 mm$^3$/sec/mm). Still other embodiments have an MRR of at least about 7 in$^3$/min·in (75.6 mm$^3$/sec/mm). Still other embodiments have an MRR of at least about 10 in$^3$/min·in (108 mm$^3$/sec/mm). Still other embodiments have an MRR of at least about 15 in$^3$/min·in (162 mm$^3$/sec/mm). In still other embodiments, the MRR is as low as 0.25 in$^3$/min·in (2.7 mm$^3$/sec/mm) or as high as 20 in$^3$/min·in (216 mm$^3$/sec/mm). Specific embodiments within this example MRR range include 1 in$^3$/min·in (10.8 mm$^3$/sec/mm) to about 15 in$^3$/min·in (162 mm$^3$/sec/mm), or about 1 in$^3$/min·in (10.8 mm$^3$/sec/mm) to about 10 in$^3$/min·in (108 mm$^3$/sec/mm), or about 1 in$^3$/min·in (10.8 mm$^3$/sec/mm) to about 6 in$^3$/min·in (64.8 mm$^3$/sec/mm).

Thus, grinding processes configured in accordance with an embodiment of the present invention can be conducted, for example, at an MRR of about 0.25 in$^3$/min·in (2.7 mm$^3$/sec/mm) to about 20 in$^3$/min·in (217 mm$^3$/sec/mm) and at a specific cutting energy of less than about 12 Hp/in$^3$·min (29.7 J/mm$^3$).

Exemplification

A series of experiments were conducted to access OD cylindrical grinding using an OPTIMOS™ abrasive wheel. Workpieces, each 5 inches in diameter by ⅜ inch thick, were abraded under various conditions to establish grinding parameters and to identify conditions for high material removal rates (MRR). Grinding was performed using a Bryant grinding machine model LL3 equipped with an OPTIMOS™ abrasive wheel (175 mm×12.7 mm×22.23 mm) (TGX120-K12-VCF5; Saint Gobain Abrasives, Inc., Worcester, Mass.).

The grinding machine was operated at a grinding wheel peripheral speed of 6,000 to 24,600 surface feet per minute (sfpm) (30 to 120 M/Sec.) Note that this range is a function of machine capability (e.g., in terms of speed and motor horsepower), and not intended to be a limitation of the present invention. In each experiment, the depth of cut (DOC) was about 0.1181 mm. Coolant containing 5 to 6% (by volume) of OM-300 Master Chemical water soluble oil was applied using a ¼ by 0.050 inch nozzle at 200 pounds per square inch (PSI) for the grind coolant nozzle and at 650 PSI for the scrubber nozzle. The pressure was adjusted to achieve a coolant jet velocity that matched the wheel speed.

Table 1 contains the ranges for grinding parameters that resulted from the experiments.

TABLE 1

| | Resulting Grinding Parameters | | | | |
|---|---|---|---|---|---|
| Workpiece Material | MRR[1] (in$^3$/min/in) | Power[2] (hp/in) | SCE[3] (hp/in$^3$/min) | Ra[4] (microinches) | G-Ratio[5] |
| Ductile iron 80-60-03, soft (40 Rb) | 1.0-14.8 | 16.2-57.0 | 4.07-1.39 | 33-46 | 162-438 |

TABLE 1-continued

| Workpiece Material | Resulting Grinding Parameters MRR[1] ($in^3$/min/in) | Power[2] (hp/in) | SCE[3] (hp/$in^3$/min) | Ra[4] (microinches) | G-Ratio[5] |
|---|---|---|---|---|---|
| Ductile iron 80-60-03, hard (20 Rc) | 1.0-15.0 | 18.6-54.4 | 4.00-1.90 | 31-48 | 140-286 |
| AISI 1018 steel (88 Rb) | 1.0-7.5 | 18.4-46.6 | 9.14-2.78 | 45-114 | 40-224 |
| AISI 4340 steel, soft (96 Rb) | 1.0-5.4 | 18.0-41.3 | 8.30-3.77 | 42-65 | 83-179 |
| AISI 4340 steel, hard (Rc 42) | 1.0-4.6 | 18.9-47.3 | 7.37-2.81 | 52-67 | 67-149 |
| AISI D2 steel, soft (Rb 95) | 1.0-5.0 | 22.3-42.7 | 11.72-6.21 | 94-135 | 42-67 |

[1]Range of material removal rate (MRR) successfully achieved.
[2]Range of unit power for the MRR values achieved.
[3]Range of specific cutting energy (SCE) for MRR values presented. SCE is the derivative value at a specified MRR.
[4]Range of surface finish parameter for MRR values achieved.
[5]Volume of material removed divided by the volume of the abrasive wheel consumed.

Figure 2:
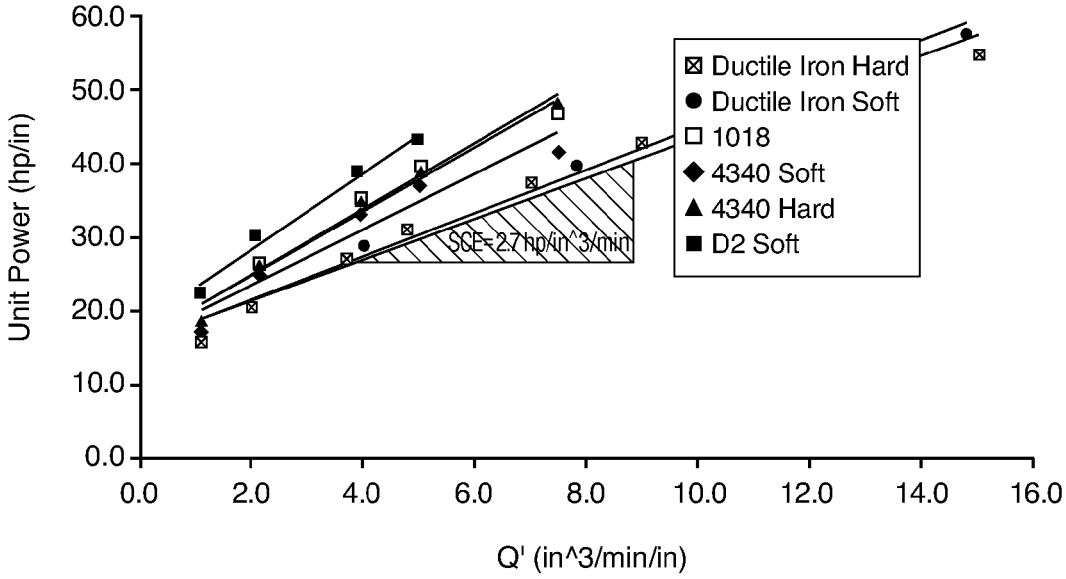
FIG. 2 is a plot of unit power vs. material removal rate for OD cylindrical grinding of several materials according to various embodiments of the present invention.

FIG. 2 is a plot of unit power vs. material removal rate for OD cylindrical grinding of the materials shown in Table 1. The results of the experiments show that satisfactory MRR can be achieved under a range of grinding conditions. The experiments showed that the grinding using a coolant containing water soluble grinding oil provided high material removal rates, very high G-Ratios, and good surface finish.

While this invention has been particularly shown and described with references to example embodiments thereof, it will be understood by those skilled in the art that various changes in form and details may be made therein without departing from the scope of the invention encompassed by the appended claims.

What is claimed is:

1. A method for cylindrical grinding of a workpiece, comprising:

cylindrical grinding including contacting a bonded abrasive wheel to an external surface of a workpiece to remove material from the workpiece, forming a cylindrical surface of the workpiece and modifying a diameter of the workpiece; and wherein the bonded abrasive wheel has a permeable structure that includes interconnected porosity, and the cylindrical grinding is carried out at a specific cutting energy of less than about 12 Hp/$in^3$·min (29.7 J/$mm^3$), and a material removal rate of at least about 1 $in^3$/min·in (10.8 $mm^3$/sec/mm).

2. The method of claim 1 wherein the bonded abrasive wheel contains at least about 3 volume percent of a filamentary sol-gel alpha-alumina abrasive grain having an average length-to-cross-sectional-width aspect ratio of greater than about 4:1, or agglomerates thereof.

3. The method of claim 2 wherein the filamentary sol-gel alpha-alumina abrasive grain has an average aspect ratio of at least about 5:1 and comprises predominantly alpha alumina crystals having a size no greater than about 1 micron.

4. The method of claim 1 wherein the bonded abrasive wheel contains superabrasive grains, or agglomerates thereof.

5. The method of claim 1 wherein the bonded abrasive wheel includes about 35 to about 80 volume percent interconnected porosity.

6. The method of claim 1 wherein the specific cutting energy is in the range of about 1 Hp/$in^3$·min (2.7 J/$mm^3$) to about 10 Hp/$in^3$·min (27 J/$mm^3$).

7. The method of claim 1 wherein the specific cutting energy is in the range of about 1 Hp/$in^3$·min (2.7 J/$mm^3$) to about 5 Hp/$in^3$·min (13.5 J/$mm^3$).

8. The method of claim 1 wherein the bonded abrasive wheel is rotated at a velocity of about 66 m/sec to about 150 m/sec to carry out the cylindrical grinding.

9. The method of claim 1 wherein the material removal rate is at least about 5 $in^3$/min·in (54 $mm^3$/sec/mm).

10. The method of claim 1 wherein the material removal rate is at least about 10 $in^3$/min·in (108 $mm^3$/sec/mm).

11. The method of claim 1 wherein the workpiece is ground in the presence of a water soluble oil.

12. The method of claim 1 wherein the workpiece is ground in the presence of a coolant which includes water soluble oil and water.

13. The method of claim 12 wherein the coolant includes about 3 to about 6 percent by volume water soluble oil.

14. The method of claim 1 further comprising the step of providing a coherent jet of coolant to a grinding zone between the bonded abrasive wheel and workpiece.

15. The method of claim 1 wherein the workpiece includes a material selected from the group consisting of titanium, inconel, iron, carbon steel, alloys, and combinations thereof.

16. A method for cylindrical grinding of a workpiece, comprising:

cylindrical grinding including contacting a bonded abrasive wheel to a workpiece and removing material along an entire circumference of the workpiece;

wherein the bonded abrasive wheel has a permeable structure that includes interconnected porosity, and the cylindrical grinding is carried out at a specific cutting energy of less than about 12 Hp/$in^3$·min (29.7 J/$mm^3$), and a material removal rate of at least about 5 $in^3$/min·in (54 $mm^3$/sec/mm); and wherein the bonded abrasive wheel includes about 35 to about 80 volume percent interconnected porosity.

17. The method of claim 16 wherein the bonded abrasive wheel contains at least one of superabrasive grains, filamentary sol-gel alpha-alumina abrasive grain having an average length-to-cross-sectional-width aspect ratio of greater than about 4:1, and agglomerates thereof.

18. The method of claim 16 wherein the specific cutting energy is in the range of about 1 Hp/in$^3$·min (2.7 J/mm$^3$) to about 5 Hp/in$^3$·min (13.5 J/mm$^3$).

19. The method of claim 16 wherein the material removal rate is at least about 10 in$^3$/min·in (108 mm$^3$/sec/mm).

20. The method of claim 16 wherein the workpiece is ground in the presence of a water soluble oil.

21. A method for cylindrical grinding of a workpiece, comprising:

cylindrical grinding including contacting a bonded abrasive wheel to a workpiece and rotating at least one of the workpiece around a workpiece rotational axis and the bonded abrasive wheel around a wheel rotational axis, wherein during cylindrical grinding the workpiece rotational axis and the wheel rotational axis are parallel to each other;

wherein the bonded abrasive wheel has a permeable structure that includes interconnected porosity, and the cylindrical grinding is carried out at a specific cutting energy of less than about 10 Hp/in$^3$·min (29.7 J/mm$^3$), and a material removal rate of at least about 5 in$^3$/min·in (54 mm$^3$/sec/mm); and wherein the bonded abrasive wheel includes filamentary sol-gel alpha-alumina abrasive grain having an average length-to-cross-sectional-width aspect ratio of greater than about 4:1, and agglomerates thereof, and about 35 to about 80 volume percent interconnected porosity, and at least one of superabrasive grains.

22. The method of claim 21 wherein the specific cutting energy is in the range of about 1 Hp/in$^3$·min (2.7 J/mm$^3$) to about 5 Hp/in$^3$·min (13.5 J/mm$^3$).

23. The method of claim 21 wherein the material removal rate is at least about 10 in$^3$/min·in (108 mm$^3$/sec/mm).

24. The method of claim 21 further comprising the step of providing a coherent jet of coolant to a grinding zone between the bonded abrasive wheel and workpiece.

25. The method of claim 21, wherein during cylindrical grinding the bonded abrasive wheel is rotated about the wheel rotational axis and the workpiece is simultaneously rotated about the workpiece rotational axis.

* * * * *